US007976396B2

(12) United States Patent
Boretskin

(10) Patent No.: US 7,976,396 B2
(45) Date of Patent: Jul. 12, 2011

(54) INFLATABLE INTERACTIVE AMUSEMENT STRUCTURE INCORPORATING ELECTRONIC AUDIO AND VISUAL EFFECTS

(76) Inventor: Steven M. Boretskin, Toms River, NJ (US)

( * ) Notice: Subject to any disclaimer, the term of this patent is extended or adjusted under 35 U.S.C. 154(b) by 95 days.

(21) Appl. No.: 12/590,580

(22) Filed: Nov. 10, 2009

(65) Prior Publication Data

US 2010/0120323 A1 May 13, 2010

Related U.S. Application Data

(60) Provisional application No. 61/198,872, filed on Nov. 12, 2008.

(51) Int. Cl.
*A63G 31/12* (2006.01)
*A63J 11/00* (2006.01)

(52) U.S. Cl. ..... 472/134; 472/62

(58) Field of Classification Search ..... 472/59, 472/60, 62, 130, 134; 446/220–226; 434/55, 434/59; 441/40, 41
See application file for complete search history.

(56) References Cited

U.S. PATENT DOCUMENTS

| | | | | |
|---|---|---|---|---|
| 5,425,677 | A * | 6/1995 | Gleeson et al. | 472/136 |
| 5,769,725 | A * | 6/1998 | Ogden et al. | 472/59 |
| 5,772,535 | A * | 6/1998 | Murphy | 473/415 |
| 5,906,373 | A * | 5/1999 | Sanders | 273/349 |
| 6,095,927 | A * | 8/2000 | Malone | 472/62 |
| 6,650,246 | B2 * | 11/2003 | Field et al. | 340/657 |
| 6,875,119 | B2 * | 4/2005 | Murphy et al. | 472/134 |
| 7,300,354 | B2 * | 11/2007 | Field et al. | 472/117 |
| 2006/0252563 | A1 * | 11/2006 | Werner | 472/117 |

* cited by examiner

*Primary Examiner* — Kien T Nguyen
(74) *Attorney, Agent, or Firm* — Clifford G. Frayne

(57) ABSTRACT

An interactive inflatable amusement structure in the form of an obstacle course or play area which incorporates audio and visual electronics at various locations within the obstacle course through the use of a plurality of transmitter/receivers in radio frequency communication with a central control unit for transmitting data such as elapsed time and points, the central control unit positioned at the egress to the inflatable structure proximate the start of the obstacle course or inflatable game, bounce, etc., and the transmitter/receivers positioned within pockets or the like formed at various locations on the inflatable obstacle course structure.

6 Claims, 3 Drawing Sheets

INFLATABLE INTERACTIVE AMUSEMENT STRUCTURE INCORPORATING ELECTRONIC AUDIO AND VISUAL EFFECTS

RELATED APPLICATIONS

Applicant claims the benefit of provisional application Ser. No. 61/198,872, filed Nov. 12, 2008.

BACKGROUND OF THE INVENTION

1. Field of the Invention

The present invention relates to inflatable structures, and in particular, to inflatable amusement structures such as obstacle courses, bounce houses, slides and the like, which incorporate electronic audio and visual effects, and scoring and timing ability.

2. Description of the Prior Art

Inflatable structures which are maintained in an expanded or inflated orientation through the use of blowers have found many uses in commerce including inflatable billboards, inflatable projection screens for the viewing of movies, and inflatable structures in the form of tents maintained in position over tennis courts or athletic fields which allow the individual to play a particular sport despite the weather. Inflatable structures are also used in the amusement industry at fairs, family get-togethers, and other social events. Inflatable water slides or dry slides can be erected utilizing the inflatable structure and a blower to maintain the inflation.

Applicant has developed inflatable obstacle courses for the amusement of children and adults. The obstacle course is inflated through blowers which maintain the expansion and inflation of the obstacle course while adults or children attempt to circumnavigate the obstacles by racing from one end of the obstacle course to the other. The inflated obstacles in the path of the person may vary and can include without limitation, tunnels, slides, bowling pins, and the like. These inflatables may vary in size but typical dimensions may be 12 m in length, 8 m in width, and heights of 5 m.

One of the shortcomings to amusement inflatables of the type described is that they could not provide audio and visual effects unless they were hardwired with speakers, screens, and the associated hardware. This hardwiring defeated the purpose of the inflatable which was designed to be installed, inflated and used at a location which required minimal set up time and minimal take down time. There therefore has been a need for an apparatus and method that can allow the owner, installer or user of an inflatable structure, primarily used for amusement purposes, to incorporate audio and visual effects, scoring, and timing to enhance the enjoyment of the people who use the inflatable amusement. The audio and visual effects are easily installed and incorporated in the inflatable and are easily removed for storage and transportation when not in use.

OBJECTS OF THE INVENTION

An object of the present invention is to provide for an interactive inflatable structure which incorporates audio and/or visual electronic effects.

A still further object of the present invention is to provide for a novel interactive inflatable amusement structure which incorporates audio and/or visual electronic effects.

A still further object of the present invention is to provide for a novel interactive inflatable amusement structure in which various audio and/or visual electronic emitters and transmitters can be positioned in the amusement structure for interactive engagement with the user generating audio and visual signals.

A still further object of the present invention is to provide for a novel interactive inflatable amusement structure in which there are a plurality of audio and/or visual electronic transmitter/receivers positioned about the inflatable amusement structure in communication via radio frequency with a control member positioned at the egress to the interactive inflatable amusement structure.

A still further object of the present invention is to provide for a novel interactive inflatable amusement structure in which various audio visual electronic emitters and transmitters are in communication with a central receiver for the transmission and collection of data, including but not limited to elapsed time and total points.

SUMMARY OF THE INVENTION

An interactive inflatable amusement structure in the form of an obstacle course or play area which incorporates audio and visual electronics at various locations within the obstacle course through the use of a plurality of transmitter/receivers in radio frequency communication with a central control unit for transmitting data such as elapsed time and points, the central control unit positioned at the egress to the inflatable structure proximate the start of the obstacle course or inflatable game, bounce, etc., and the transmitter/receivers positioned within pockets or the like formed at various locations on the inflatable obstacle course structure.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
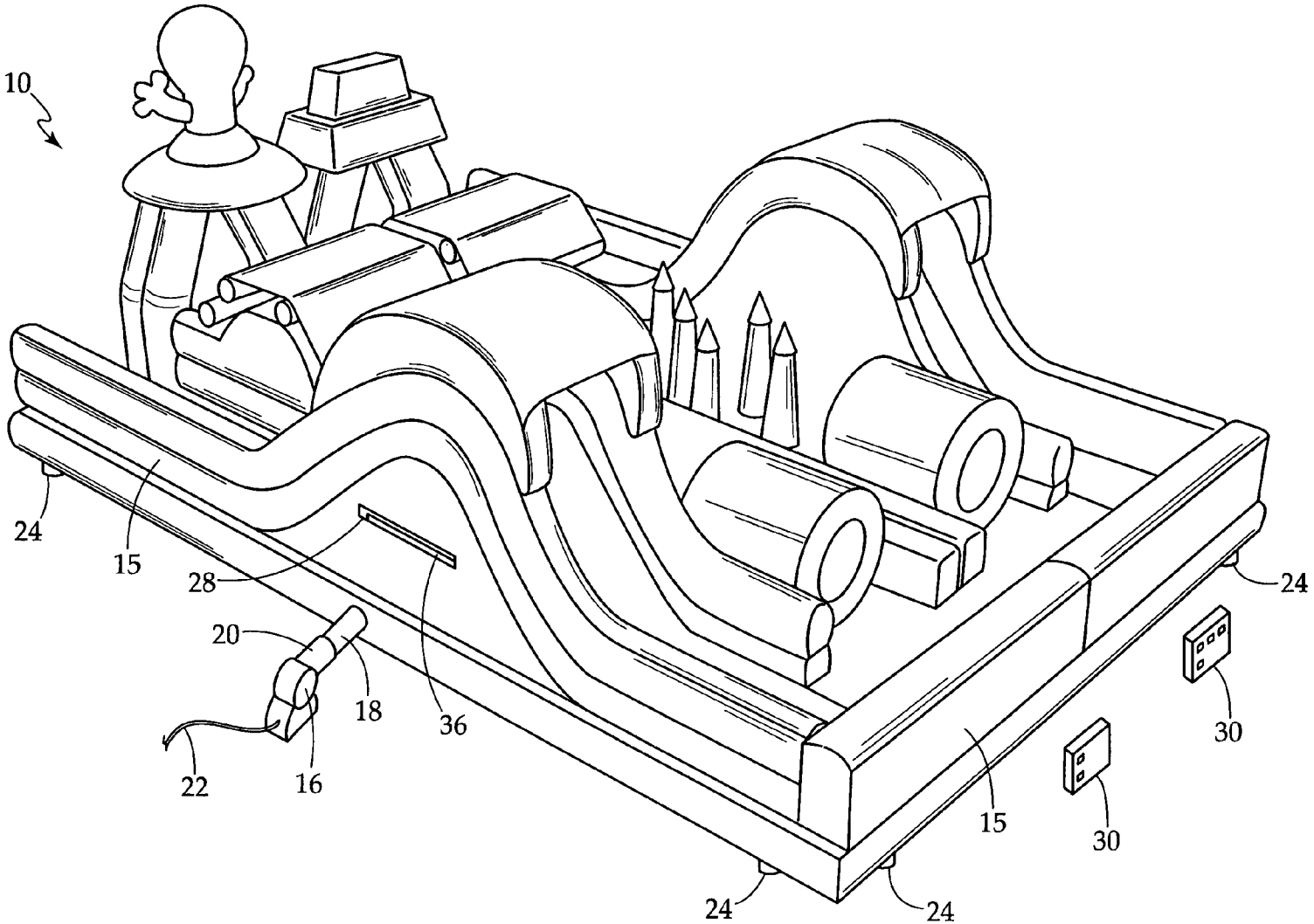
FIG. 1 is a perspective view of a typical interactive inflatable amusement obstacle course.
Figure 2:
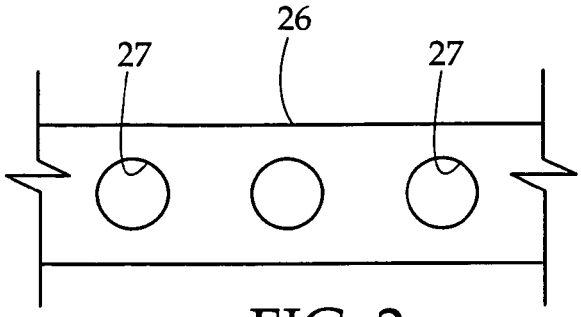
FIG. 2 is a partial cross section illustrating the manner in which the interactive inflatable amusement obstacle course is maintained in an inflatable condition.

FIGS. 1 and 2 are a perspective and a partial cross sectional view of an interactive amusement structure 10 of the present invention. The interactive amusement structure 10 is inflatable and is fabricated from a plurality of panels 15 comprised of plastic vinyl or the like of approximately 10 mil thickness, which can be sewn or heat welded together to form a desired interactive amusement structure. The interactive amusement structure illustrated in FIG. 1 is an obstacle course, and it will be recognized by those of ordinary skill in the art that the form of the obstacle course may vary without departing from the scope of the invention. Other inflatable structures which could include the interactive electronic audio and video effects could include mazes or the like. The inflatable interactive amusement structure 10 is in communication with a blower or series of blowers 16 which provide air to the interior of the inflatable interactive amusement structure 10. This causes the inflation of the interactive amusement structure and maintains the inflation of the interactive amusement structure during play. The attachment of the blower 16 to the inflatable interactive amusement structure is normally accomplished by a sleeve member 18 integrally attached to a panel of the interactive amusement structure and securable to the outlet 20 of the blower 16, the blower being in communication with a power source 22. The interactive amusement structure may be of such weight that it maintains its own contact with the underlying subsurface or ground, however, along the lower edge of the interactive amusement structure, and secured to the panels 15 forming the interactive amusement structure, there may be a series of loops 24 which can be secured to pegs driven into the underlying subsurface.

In order to provide stability to the interactive amusement structure, a series of baffles 26 of honeycomb design or tubular structure would be fabricated within the inflatable interactive amusement structure in order to direct the air flow from the blower or blowers 16 in order to provide a degree of stability and rigidity to the faces formed by the heat sewn or heat welded panels 15 forming the inflatable interactive amusement structure 10. The baffles 26 may be oriented vertically or horizontally within the interactive amusement structure, the baffles being constructed of the same material as the exterior panels forming the interactive amusement structure. The baffles 16, so positioned, direct the air flow from the blowers within the interactive amusement structure in order to maintain its inflatability and many of the baffles 16 may be formed with a plurality of apertures 27 there through to further aid in directing the air in order to insure the full inflation of the interactive amusement structure.

There is selectively positioned on the panels 16 forming the interactive amusement structure 10, a plurality of sealable closure vents 28 which are comprised in the form of zippers 30 which allow for the rapid deflation of the interactive amusement structure once its use is terminated. These sealable closure vents 28 can also be used to allow for a certain amount of bleed off of air within the inflatable interactive amusement structure if desired. The rapid deflation allowed by these sealable closure vents 28 allows for the ease of storage and transportation of the interactive amusement structure.

Figure 3:
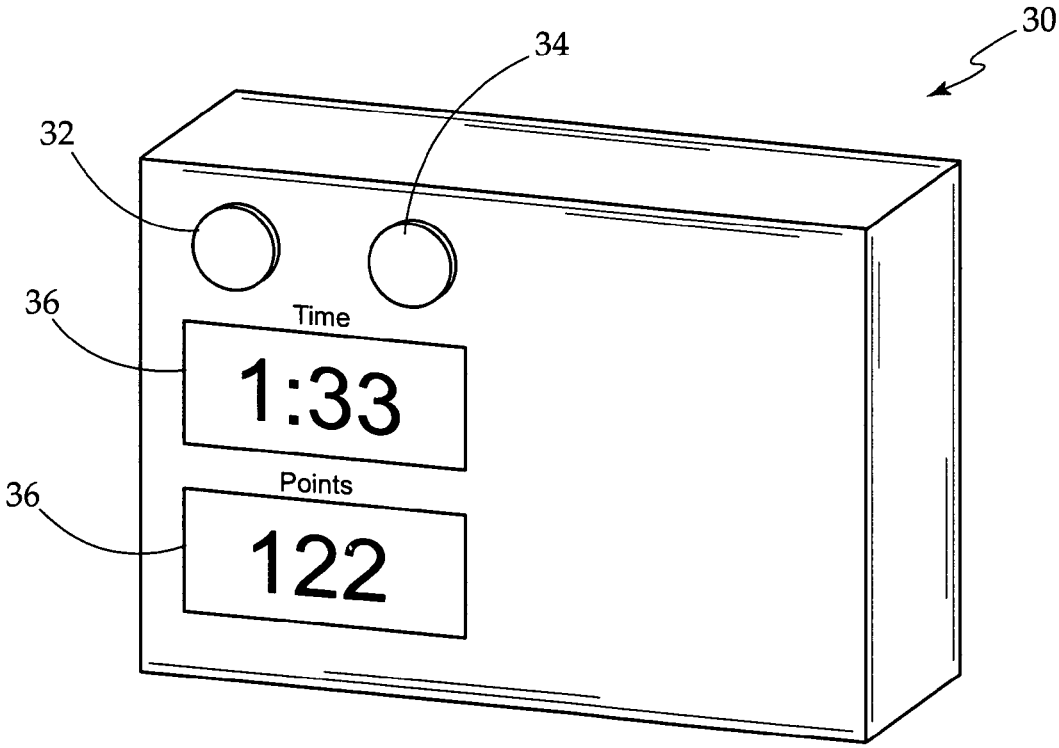
FIG. 3 is a front view of an electronic control panel.
Figure 5:
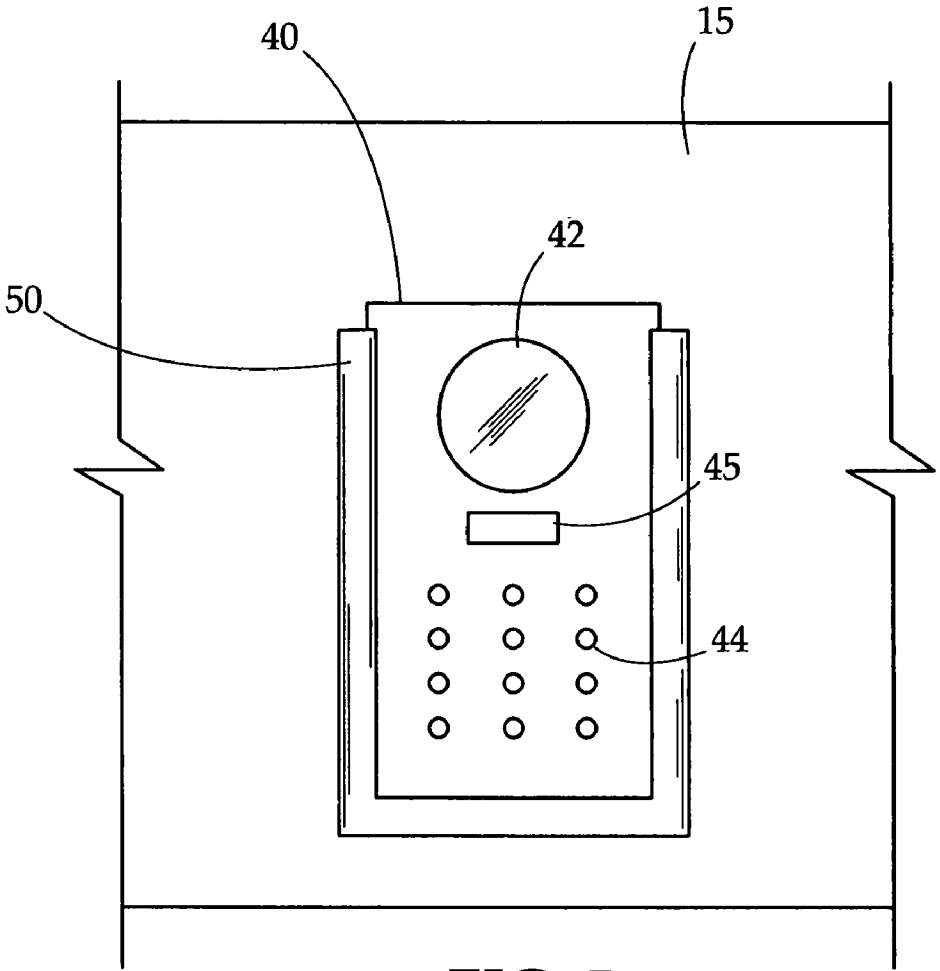
FIG. 5 is a close-up view of a pocket which can be incorporated at various locations within the interactive inflatable amusement obstacle course for receipt of a remote transmitter.
Figure 4:
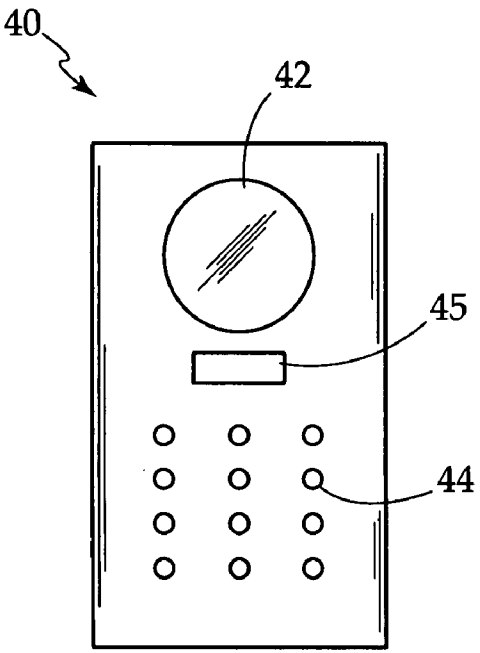
FIG. 4 is a perspective view of a transmitter.

FIG. 3 is a front view of an electronic control panel 30 for use with the inflatable interactive amusement structure, which control panel controls audio and visual effects. FIG. 4 is a front view of a remote unit which would be in wireless contact with the control panel in which would be positioned in a plurality of locations within the inflatable interactive amusement structure. FIG. 5 is a view of the remote unit of FIG. 4 positioned within a pocket formed on the panels 16 which are used to construct the inflatable interactive amusement structure.

The control panel 30 could either be battery operated or hard wired, and would be positioned at the ingress to the interactive amusement structure 10 (See FIG. 1). The control panel would have an on/off button 32, a reset button 34, and one or more LED displays 36. Each remote unit 40 would be battery powered and would be in wireless communication with the control unit 30. The remote unit 40, which is a combination transmitter/receiver, would have a manual button 42 thereon which when depressed by an individual would cause the remote unit to send a signal to the control unit 30 identifying the remote unit 40 and the fact that it had been tactilly depressed. The depression of the button 42 of the remote unit 40 may either activate or deactivate the remote unit 40. This may include the activation/deactivation of an audio sound 44 emanating from the unit or the activation/deactivation of a visual signal 45 in the form of a light or such emanating from the unit. FIG. 5 illustrates the manner in which the remote units 40 are positioned on the panels 15 which comprise the inflatable interactive amusement structure 10 utilizing receptacle pockets 50 which are formed of the same material as the panels and dimensioned to slidably receive and retain the remote units.

The control box 30 and remote units 40 positioned on the inflatable interactive amusement structure 10, allow for a variety of games or competitions to be devised among participants. The control panel display is capable of displaying elapsed time and points. In one scenario, individuals hit the reset button on the control panel to reset it to zero. The individual then traverses the inflatable interactive amusement structure attempting to seek out all of the remote units. The individual would depress the button on the remote units which would activate/deactivate an audio or visual signal and simultaneously transmit to the control panel that that remote unit had been activated/deactivated. In this manner, the player's actual time in traversing the inflatable interactive amusement structure is kept and points are tabulated for the number of remote units which the individual finds and activates/deactivates. When the player exits the inflatable interactive amusement structure, the player depresses a stop button on the control panel and the control panel provides an electronic read out of the elapsed time and the number of points scored based on the number of buttons located and depressed on the remote units. Successive players or individuals would then repeat the exercise attempting to score a better elapsed time or a higher point score. The wireless and electronic controls allow for variations on this game which could include multiple players traversing the inflatable interactive amusement structure at the same time. The control panel 30 permits the resetting of the remove units after each individual traverse.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. An inflatable interactive amusement structure which incorporates electronic audio and video effects, the inflatable interactive amusement structure comprising:

a plurality of exterior panels sewn or heat welded, together to form an inflatable structure in the form of an obstacle course or maze, for transit by an individual;

a sleeve member secured to one of said exterior panels, said sleeve member secured to a blower means, said blower means in communication with a power source, said blower means for the inflation and maintenance of inflation of said inflatable interactive amusement structure, the structure further including a plurality of interior baffle members sewn or heat welded in communication with said exterior panels, said interior baffle panel members having a plurality of apertures there through for the direction and passage of air from said blower means and for providing internal structural integrity to said inflatable interactive amusement structure;

a plurality of pockets formed and selectively positioned on said exterior panels for the receipt of audio/visual transmitter/receivers for providing audio signals and visual signals at a plurality of locations within said inflatable interactive amusement structure for activation and/or response by an individual traversing said inflatable interactive amusement structure, said plurality of audio/visual transmitter/receivers in communication with a central control panel positioned at a point of ingress to said inflatable interactive amusement structure for the receipt of signals from said plurality of audio/visual transmitter/receivers within said inflatable interactive amusement structure, said signals tactily activated or deactivated by said individual traversing said inflatable interactive amusement structure.

2. The inflatable interactive amusement structure in accordance with claim 1 wherein said central control panel maintains a timing signal for the amount of time an individual requires to ingress and egress said inflatable interactive amusement structure.

3. The inflatable interactive amusement structure in accordance with claim 1 wherein said central control panel further provides a point tabulation for an individual's tactile interaction with said audio/visual transmitter/receivers within said inflatable interactive amusement structure by said individual as said individual traverses said structure.

4. The inflatable interactive amusement structure in accordance with claim 1 wherein said audio/visual transmitter/receivers permit resetting of said audio/visual transmitter/receivers from said central control panel.

5. The inflatable interactive amusement structure in accordance with claim 1 wherein said central control panel and said audio/visual transmitter/receivers communicate by radio frequency.

6. The inflatable interactive amusement structure in accordance with claim 1 wherein said exterior panels are formed with a plurality of deflation vents facilitating the deflation of the inflatable interactive amusement structure after use.

* * * * *